US009376989B2

(12) United States Patent
Peters et al.

(10) Patent No.: US 9,376,989 B2
(45) Date of Patent: Jun. 28, 2016

(54) FUEL TANK PRESSURE RELIEF VALVE CLEANING

(71) Applicant: Ford Global Technologies, LLC, Dearborn, MI (US)

(72) Inventors: Mark W. Peters, Wolverine Lake, MI (US); Robert Roy Jentz, Westland, MI (US); Aed M. Dudar, Canton, MI (US); Matthew Werner, Marysville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 357 days.

(21) Appl. No.: 13/944,741

(22) Filed: Jul. 17, 2013

(65) Prior Publication Data

US 2015/0020779 A1 Jan. 22, 2015

(51) Int. Cl.
*F02M 25/08* (2006.01)

(52) U.S. Cl.
CPC ..... *F02M 25/08* (2013.01); *F02M 25/0809* (2013.01)

(58) Field of Classification Search
CPC ... F02M 37/20; F02M 25/0836; F02M 17/04; F02M 25/0854; F02M 25/089; F02M 25/08; F02M 21/0293; F02M 63/0205; F02M 26/55; F02M 35/10236; F02D 19/027; F02D 19/0628; F02D 19/025; F02D 19/026; F02D 19/022; F02D 19/0623; F02D 41/22; F02D 41/221
USPC ..... 123/506, 516, 520, 568.22, 90.57, 518, 123/406.49, 406.68, 677, 193.5; 60/39.091, 60/39.094, 779
See application file for complete search history.

(56) References Cited

U.S. PATENT DOCUMENTS 5,383,438 A * 1/1995 Blumenstock ..... F02M 25/08 123/198 D
5,614,665 A * 3/1997 Curran ..... F02M 25/0809 123/521
5,730,107 A * 3/1998 Blumenstock ..... F02M 25/0818 123/520

(Continued)

FOREIGN PATENT DOCUMENTS

CN 201511812 U 6/2010
JP 2012112305 A 6/2012
WO 2010031466 A1 3/2010

OTHER PUBLICATIONS

Dixon, Matthew, "Chrysler Evaporative Leak Detection Systems," Southern Illinois University Carbondale OpenSIUC, Department of Automotive Technology Presentations, ICAIA Fall 2008, 78 pages.

(Continued)

*Primary Examiner* — Hung Q Nguyen
*Assistant Examiner* — Brian P Monahon
(74) *Attorney, Agent, or Firm* — David Kelley; Alleman Hall McCoy Russell & Tuttle LLP

(57) ABSTRACT

Methods and systems for cleaning a pressure relieve valve for a fuel tank are disclosed. In one example approach a method for cleaning a pressure relief valve that is normally activated at a preset negative pressure in a fuel system comprises, during a test cycle, reducing fuel system pressure to a predetermined pressure which is higher than the preset pressure, and measuring pressure changes in the fuel system; and when not in the test cycle, periodically reducing the fuel system pressure to a third pressure which is less than said preset pressure.

20 Claims, 4 Drawing Sheets

(56) References Cited

U.S. PATENT DOCUMENTS

| | | | | |
|---|---|---|---|---|
| 5,765,603 | A | 6/1998 | Healy | |
| 5,925,817 | A * | 7/1999 | Kidokoro | B60K 15/03 73/40 |
| 6,009,920 | A * | 1/2000 | Palvoelgyi | B60K 15/03519 137/588 |
| 6,192,742 | B1 * | 2/2001 | Miwa | F02M 25/0809 123/520 |
| 6,533,002 | B1 * | 3/2003 | Kobayashi | B60K 15/03504 141/198 |
| 8,336,526 | B1 | 12/2012 | Martin et al. | |
| 2004/0007215 | A1 * | 1/2004 | Kawano | F02M 25/08 123/520 |
| 2004/0261765 | A1 * | 12/2004 | Osanai | F02M 25/0827 123/325 |
| 2009/0133673 | A1 * | 5/2009 | Amano | B60K 6/48 123/520 |
| 2009/0240417 | A1 * | 9/2009 | Fushiki | F02D 41/042 701/103 |
| 2011/0067487 | A1 * | 3/2011 | Haag | B60K 15/03504 73/40 |
| 2012/0215399 | A1 | 8/2012 | Jentz et al. | |
| 2012/0240906 | A1 * | 9/2012 | Shimura | B60K 15/03519 123/521 |

OTHER PUBLICATIONS

Anonymous, "Method for Purging Evap System's Carbon Canisters at High Altitudes and WOT Operations," IPCOM No. 000234170, Published Jan. 15, 2014, 2 pages.

* cited by examiner

FUEL TANK PRESSURE RELIEF VALVE CLEANING

TECHNICAL FIELD

Various embodiments relate to cleaning a pressure relief valve, performing evaporative leak diagnostics, and purging fuel vapors in a fuel system coupled to an internal combustion engine.

BACKGROUND/SUMMARY

Motor vehicles equipped with gasoline engines have fuel vapor recovery systems that collect fuel vapors from the fuel tank or fuel tank filler and store the vapors in a canister containing activated charcoal. On occasion a vapor purge operation is performed where fresh air enters the canister, desorbs stored fuel vapors, and the vapors are then inducted into the engine for combustion.

A diagnostic test also is performed on occasion to determine if there are vapor leaks in the fuel vapor recovery system. The system is sealed from atmosphere and a negative pressure created by drawing in vapors through the engine air intake until a predetermined pressure is reached. Thereafter pressure measurements are taken to determine if there is a leak.

The fuel vapor recovery system also contains a negative pressure relief valve that releases pressure at a preset negative pressure to prevent too large a negative pressure forming in the fuel vapor recovery system or fuel tank.

The inventors herein have recognized a potential problem with such systems, particularly in hybrid electric or plug-in hybrid applications. Under some driving conditions the internal combustion engine, and vapor purging, may not operate for a long period of time. Hydrocarbons may therefore be more likely to form in the pressure relief valve causing it to stick and not release at the preset negative pressure. The inventors herein have solved this problem, in one particular approach, by reducing fuel system pressure to a predetermined pressure which is higher than the preset pressure during a test or diagnostic cycle, and when not in the test cycle, periodically reducing the fuel system pressure to a third pressure which is less than the preset release pressure to unstick the pressure relief valve.

In another approach, a method for performing operations on a fuel vapor system having a vapor absorbing canister coupled between a fuel tank and an engine intake via a purge valve, and a pressure relief valve which opens at a preset negative pressure to limit maximum negative pressure in the fuel vapor system is described comprising a test operation, a vapor purge operation, and a pressure relief valve cleaning operation.

The test operation reduces fuel system pressure to a predetermined pressure which is higher than the preset pressure, measures pressure changes in the fuel system, and indicates a fault when the measurements exceed a threshold. The vapor purge operation purges fuel vapors from the fuel vapor system into the engine intake manifold by operating the purge valve, and a pressure relief valve cleaning operation reduces the fuel system pressure to a third pressure which is less than the preset pressure to force the relief valve open even when stuck closed.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
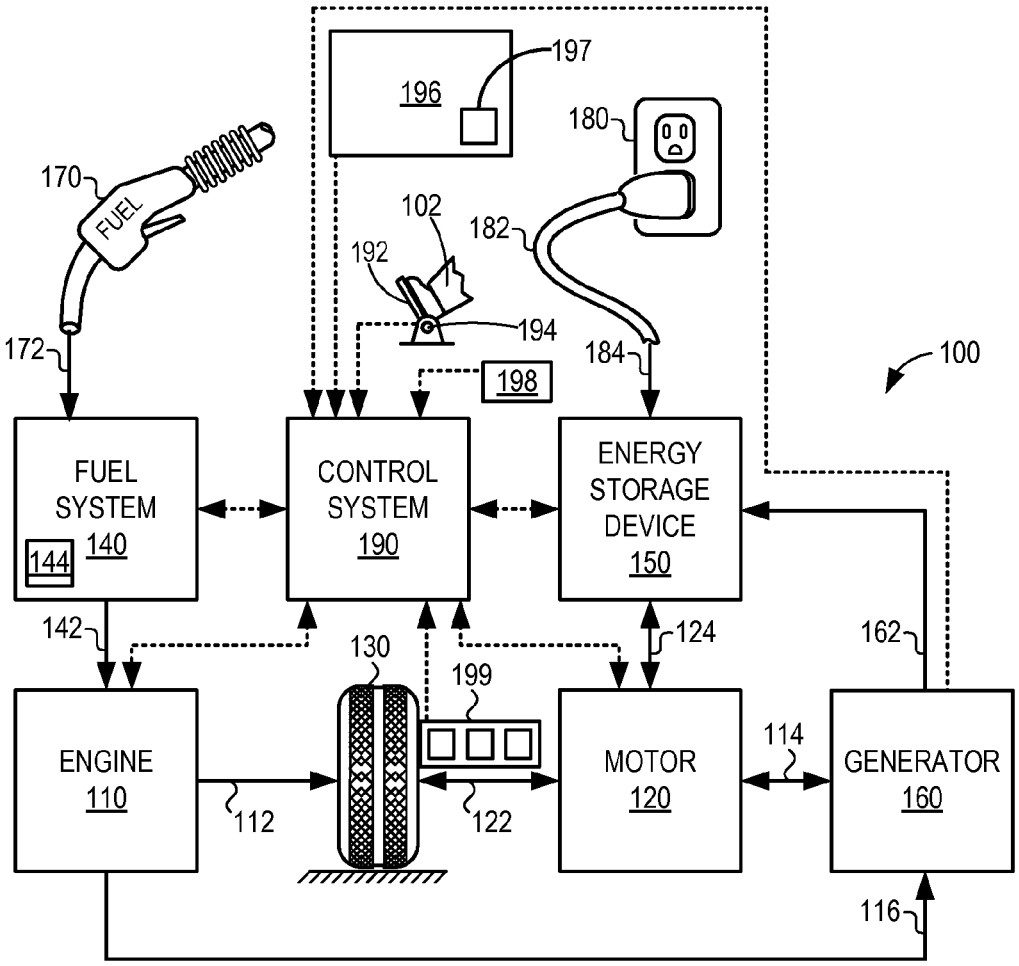
FIG. 1 shows an example vehicle propulsion system.
Figure 3:
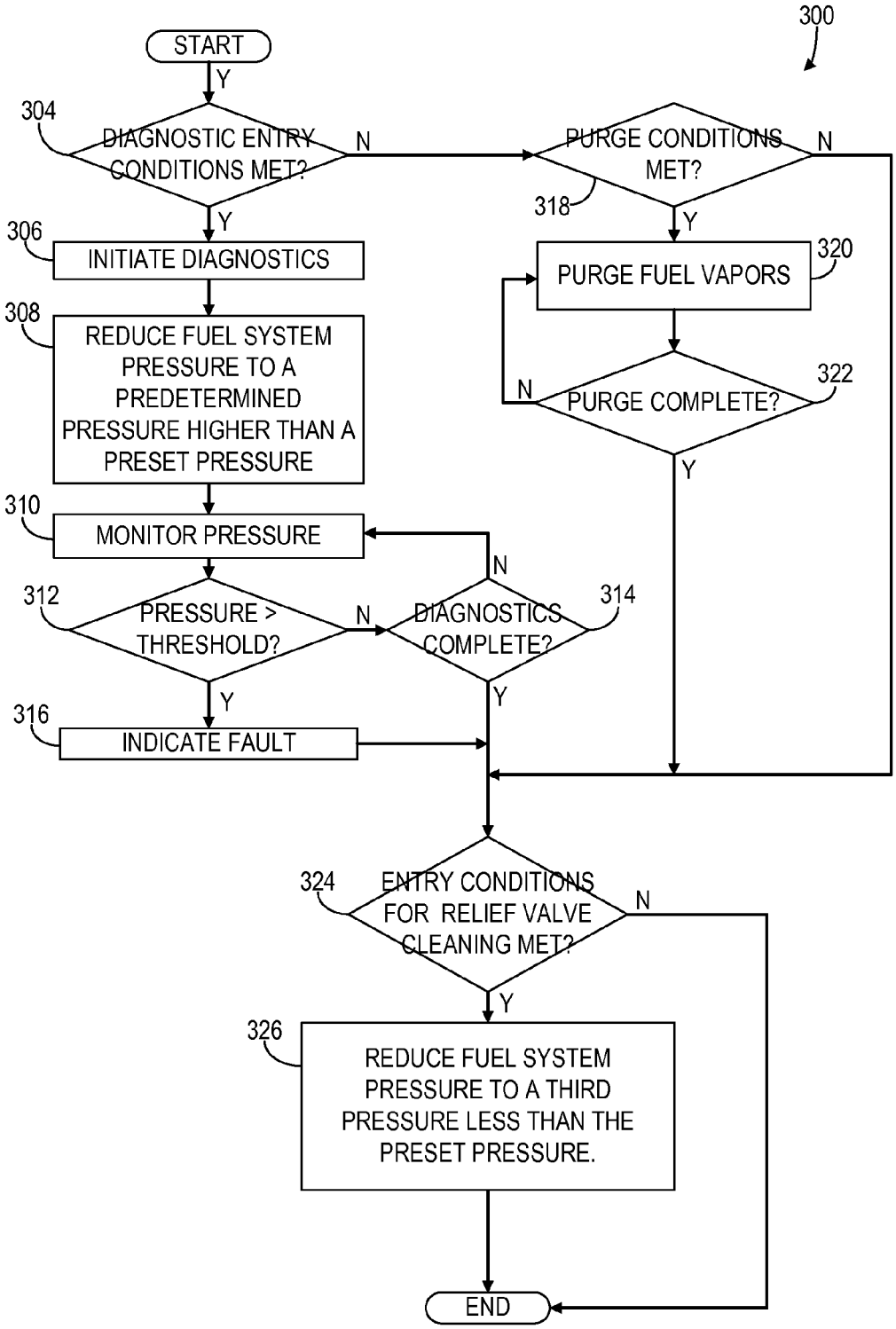
FIG. 3 shows an example method for cleaning a negative pressure relief valve for a fuel tank in accordance with the disclosure.
Figure 4:
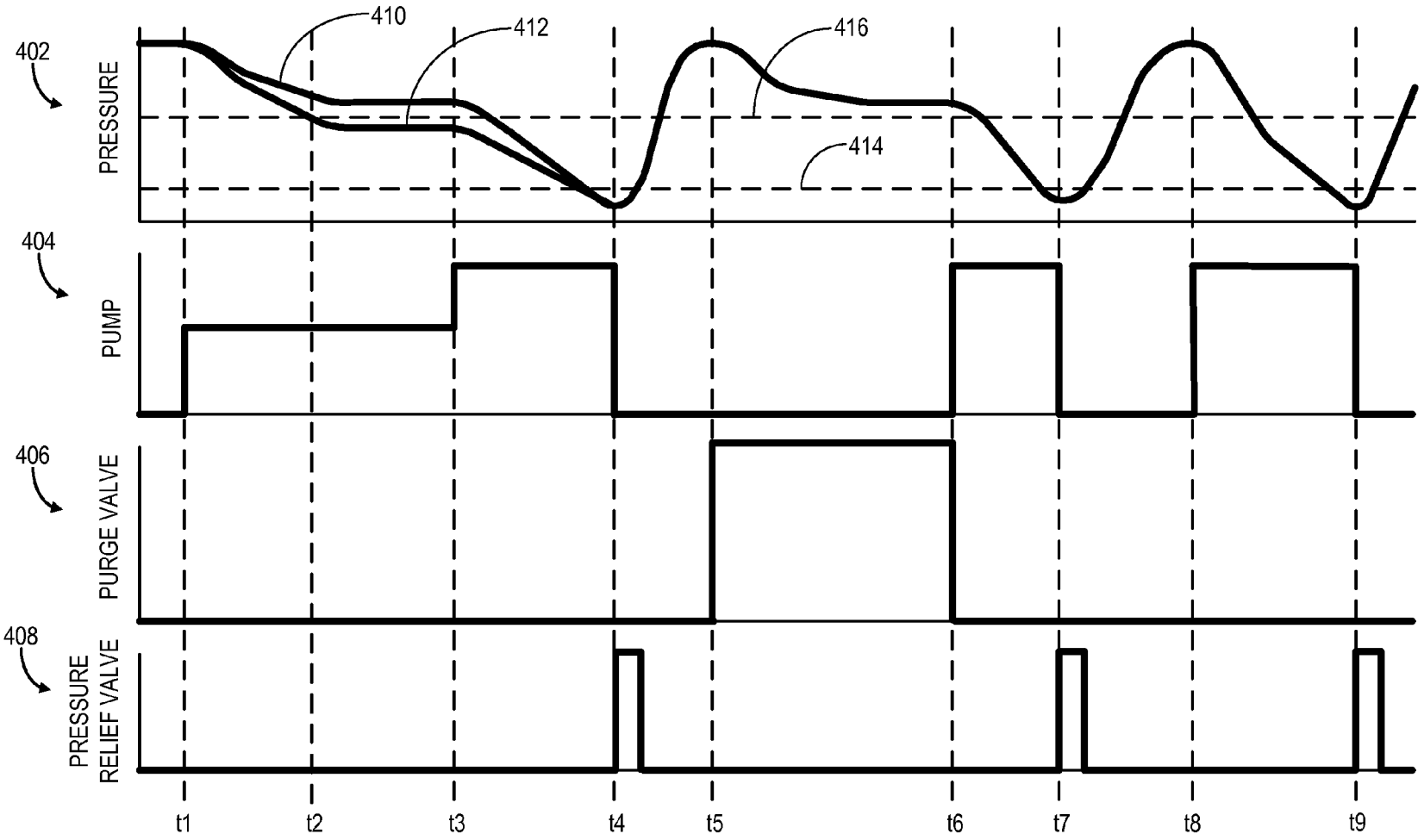
FIG. 4 illustrates an example method for cleaning a negative pressure relief valve for a fuel tank in accordance with the disclosure.

The following description relates to systems and methods for cleaning a negative pressure relieve valve for a fuel tank in a vehicle, e.g., the hybrid electric vehicle system shown in FIG. 1. As shown in the example engine system of FIG. 2, a fuel system may comprise a fuel tank, a capless fuel device including a negative pressure relief valve, and a fuel vapor recovery system coupled to the fuel tank including a vapor storage canister. The negative pressure relief valve releases pressure at a preset negative pressure to prevent too large a negative pressure forming in the fuel vapor recovery system or fuel tank. As remarked above, in hybrid electric or plug-in hybrid applications, under some driving conditions the internal combustion engine, and vapor purging, may not operate for a long period of time. Hydrocarbons may therefore be more likely to form in the pressure relief valve causing it to stick and not release at the preset negative pressure. As shown in FIGS. 3 and 4, during certain conditions, vacuum may be periodically generated in the fuel system to clean or unstick the pressure relief valve to reduce valve sticking For example, a pressure relief valve cleaning operation may be performed following a diagnostic leak test, a fuel vapor purging operation, and/or based on a predetermined schedule to clean or unstick the pressure relief valve.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 3, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Figure 2:
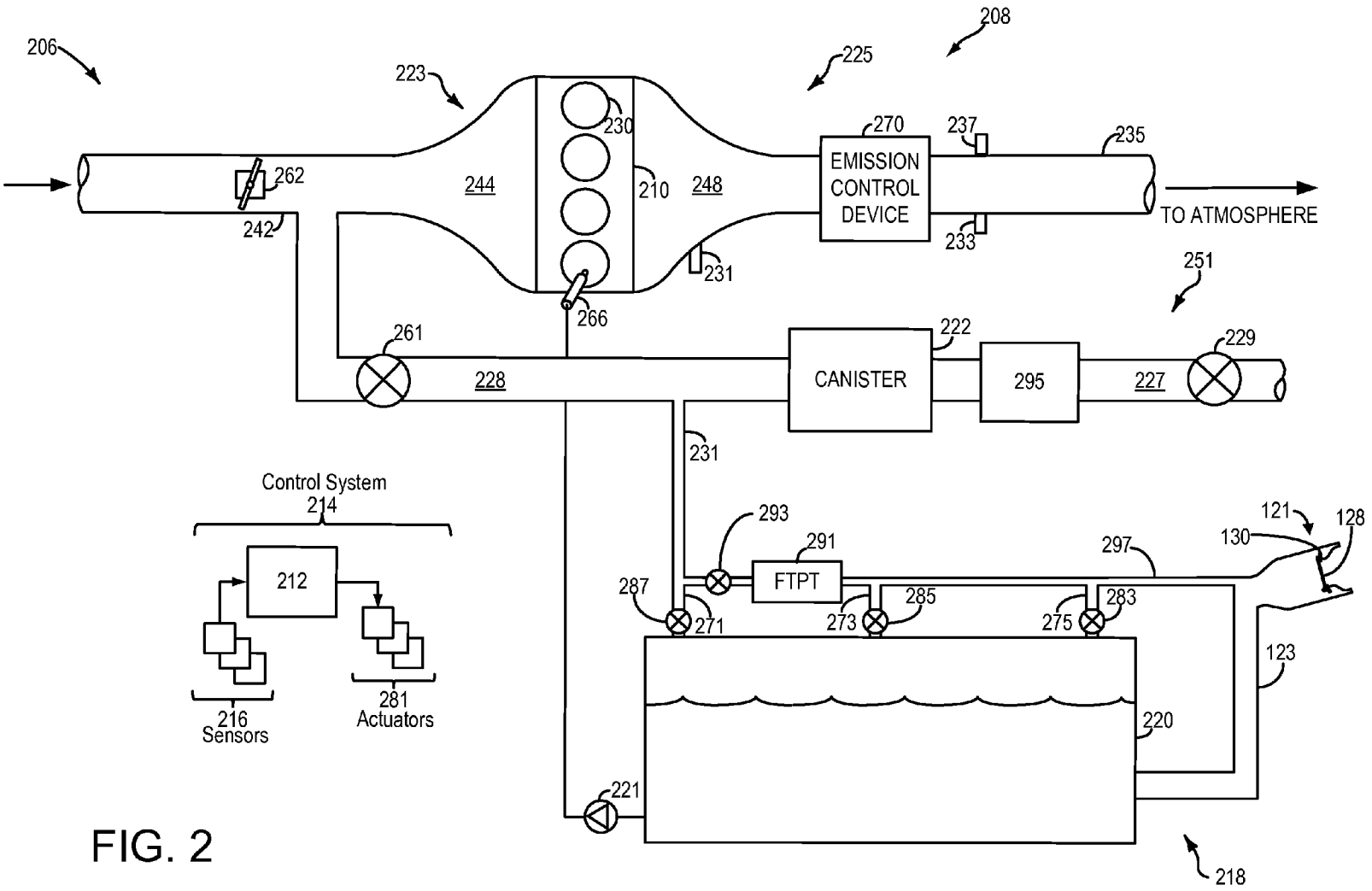
FIG. 2 shows an example vehicle system with a fuel system including a negative pressure relief valve for a fuel tank.

FIG. 2 shows another schematic depiction of a vehicle system 206. The vehicle system 206 includes an engine system 208 coupled to an emissions control system 251 and a fuel system 218. Emission control system 251 includes a fuel vapor canister 222 which may be used to capture and store fuel vapors.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system.

Vapors generated in fuel system 218 may be routed to an emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, 275. Further, in some examples, one or more fuel tank isolation valves may be included in recovery line 231 or in conduits 271, 273, 275. Among other functions, fuel tank isolation valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a capless fuel filler system 121 via a conduit 297 and may include a valve 293 for controlling fuel tank venting during refueling.

A fuel filler pipe 123 may be coupled to fuel tank 118 to direct fuel into fuel tank 118 during refueling. The capless fuel filler system 121 may be coupled to filler pipe 123. A capless fuel filler system may include a negative pressure relief valve 128 which remains closed to seal off the fuel system without a cap. For example, pressure relief valve 128 may be opened by inserting a fuel nozzle, such as a nozzle of fuel dispensing device 170, into the fuel filler neck for refueling. Negative pressure relief valve 128 releases pressure in the fuel system at a preset negative pressure to prevent too large a negative pressure forming in the fuel vapor recovery system or fuel tank. As remarked above, in hybrid electric or plug-in hybrid applications, under some driving conditions the internal combustion engine, and vapor purging, may not operate for a long period of time thus hydrocarbons may therefore be more likely to form in the pressure relief valve causing it to stick, e.g., due to stiction, and not release at the preset negative pressure. As shown in FIGS. 3 and 4 described below, during certain conditions, vacuum may be periodically generated in the fuel system to clean or unstick the pressure relief valve to reduce valve sticking For example, a pressure relief valve cleaning operation may be performed following a diagnostic leak test, a fuel vapor purging operation, and/or based on a predetermined schedule to clean or unstick the pressure relief valve.

In some examples, capless fuel filler system 121 may include a mis-fueling inhibitor (not shown) which may be sized to prevent incorrectly-sized fuel nozzles or spouts from opening the valve 128 in the capless fuel filler neck in order to reduce occurrences of mis-fueling. For example, in a diesel engine, a mis-fueling inhibitor may be configured to permit a standard-sized diesel fuel nozzle to open the capless filler neck and prevent a petrol fuel nozzle, which may be smaller than a diesel fuel nozzle, from opening the capless filler neck. As another example, in a petrol engine, a mis-fueling inhibitor may be configured to permit a standard-sized petrol fuel nozzle to open the capless filler neck and prevent a diesel fuel nozzle from opening the capless filler neck.

A fuel tank pressure transducer (FTPT) 291, or fuel tank pressure sensor, may be included between the fuel tank 220 and fuel vapor canister 222, to provide an estimate of a fuel tank pressure, and for engine-off leak detection. The fuel tank pressure transducer may alternately be located in vapor recovery line 231, purge line 228, vent line 227, or other location within emission control system 251 without affecting its engine-off leak detection ability.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a vent line 227 which may route gases out of the canister 222 to the atmosphere when storing, or trapping, fuel vapors from fuel system 218. Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake 244 is provided to the capless refueling system. While this example shows vent line 227 communicating with fresh, unheated air, various modifications may also be used. Flow of air and vapors between canister 222 and the atmosphere may be regulated by the operation of a canister vent solenoid (not shown), coupled to canister vent valve 229. For example, canister vent valve 229 may be normally open. During certain conditions, vent valve 229 may be closed to isolate the emission control system from the atmosphere.

Emissions control system 251 operates to store vaporized hydrocarbons (HCs) from fuel system 218. Under some operating conditions, such as during refueling, fuel vapors present in the fuel tank may be displaced when liquid is added to the tank. The displaced air and/or fuel vapors may be routed from the fuel tank 220 to the fuel vapor canister 222, and then to the atmosphere through vent line 227. In this way, an increased amount of vaporized HCs may be stored in canister 222. During a later engine operation, the stored vapors may be released back into the incoming air charge using the intake manifold vacuum. Specifically, the canister 222 may draw fresh air through vent line 227 and purge stored HCs into the engine intake for combustion in the engine. Such purging operation may occur during selected engine operating conditions.

In hybrid electric vehicle applications, engine run-time may be limited hence a vacuum pump may be used for leak detection during engine off conditions. Thus in some examples, an evaporative leak detection module (ELCM) 252 may be included in emission control system 251, e.g., in a vent path 227 of fuel vapor canister 222, which may be used for generating pressure in the emission control system for leak diagnostics. For example, a pump in the module may evacuate a small volume of air from the emission control system through a reference orifice in the module to obtain a reference pressure. The pump may then be operated to generate decreasing pressure in the emission control system which may be monitored by a controller and leaks may be indicated in response to the pressure in the emission control system remaining above an adjusted reference pressure, where the adjusted reference pressure is based on an actual size or diameter of the reference orifice in the ELCM. Though FIG. 2 shows an emission control system including an ELCM 295, in some examples, an ELCM may not be included and vacuum from another suitable vacuum source in the engine system, e.g., from engine intake 244 and/or one or more additional pumps, may be used to generate vacuum for leak testing during certain conditions. Further, vacuum generated by a pump in ELCM 295 (if present), the engine intake, and/or one or more additional pumps may be used to assist in a cleaning operation of the negative pressure relief valve 128 as described below.

The vehicle system 206 may further include a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 237, and pressure sensor 291. Other sensors such as pressure, temperature, air/fuel ratio, and composition sensors may be coupled to various locations in the vehicle system 206, as discussed in more detail herein. As another example, the actuators may include fuel injector 266, valve 229, throttle 262, and valve 261. The control system 214 may include a controller 212. The controller may receive input data from the various sensors, process the input data, and trigger the actuators in response to the processed input data based on instruction or code programmed therein corresponding to one or more routines. Example control routines are described herein with regard to FIG. 3.

FIG. 3 shows an example method 300 for cleaning a pressure relief valve for a fuel tank, e.g., negative pressure relief valve 128 in capless fuel filler system 121, which is normally activated at a preset negative pressure in a fuel system. In particular, method 300 may be used to periodically reduce pressure in the fuel system below the preset negative pressure in order to at least partially open or unstick the negative pressure relief valve so that the pressure relief valve remains operational to release pressure at the preset negative pressure to prevent too large a negative pressure forming in the fuel vapor recovery system or fuel tank. For example, reducing pressure in the fuel system below the preset negative pressure may force the relief valve open even when stuck closed.

At 304, method 300 includes determining if diagnostic entry conditions are met. Diagnostic entry conditions may include any suitable entry conditions for performing a diagnostic routine in the vehicle. For example, diagnostic entry conditions may include entry conditions for initiating leak diagnostics in the evaporative emission control system and/or fuel system of the vehicle. Examples of diagnostic entry conditions include a temperature in the fuel system greater than a threshold and/or an amount of vacuum or pressure in the fuel system greater than a threshold. For example, leak testing may be performed using engine off natural vacuum wherein vacuum or pressure increases are generated in the fuel tank via naturally occurring diurnal temperature changes. For example, during an increasing ambient temperature, an amount of pressure in the fuel tank may increase so that leak diagnostics in the fuel system are initiated in response to this pressure increase. As another example, during a decreasing ambient temperature, an amount of vacuum in the fuel system may increase so that leak diagnostics in the fuel system are initiated in response to the vacuum increase. However in other examples, a pump, e.g., a pump in ELCM 295, may be used to generate vacuum for leak tests. As another example, diagnostic entry conditions may be based on a diagnostic schedule. For example, if a threshold time duration has passed since a previous leak test then a leak test may be scheduled to perform at the next available opportunity, e.g., following a key-off event.

Determining if diagnostic entry conditions are met may further include determining if engine off conditions are present. In hybrid vehicle applications, determining if engine off conditions are present may include determining if the vehicle is operating in an electric mode. For example, the vehicle may be a plug-in hybrid electric vehicle which may be operated in an electric mode with the engine-off. Engine off conditions may include any condition when an engine of the vehicle is not in operation. Engine off conditions may follow a key-off event wherein the vehicle is turned off, e.g., where the vehicle is parked or is not in use and the engine is not running In some examples, an engine off condition may include a vehicle on condition, where the vehicle is moving or traveling while the engine is not in operation. However, in other examples, an engine off condition may occur when the vehicle is not moving or when the vehicle is stationary, e.g., when the vehicle is shut-down for refueling.

If diagnostic entry conditions are not met at 304, method 300 proceeds to 318 described below. However, if diagnostic entry conditions are met at 304, method 300 proceeds to 306. At 306, method 300 includes initiating diagnostics. For example, leak diagnostics in the emission control system may be initiated and performed. In the example where engine off natural vacuum is used for leak testing, initiating leak diagnostics may include sealing the emission control system from the atmosphere, e.g., closing canister vent valve 229, and putting the fuel tank in communication with the fuel vapor canister so that pressure or vacuum in the fuel tank is provided to components in the sealed emission control system. The pressure or vacuum may then be monitored to test for leaks in the system. As another example, vacuum from engine intake 244 may be provided to emission control system 151 via adjustment of purge valve 261 to control an amount of vacuum provided from the engine to the emission control system. As still another example, a leak detection pump, if included in the system, may be actuated to generate pressure or vacuum in the emission control system for leak testing. For example ELCM 295 may be operated for a duration to generate pressure changes in the system for leak testing while the emission control system is sealed off from the atmosphere, e.g., while the canister vent valve is in a closed position.

During diagnostic tests and other engine operating conditions the fuel vapor system negative pressure may remain above the preset negative pressure at which the negative pressure relief valve opens. Thus, at 308, method 300 includes reducing fuel system pressure to a predetermined pressure higher than the preset pressure. In particular, an amount of negative pressure generated in the emission control system for leak testing may be adjusted to remain above this preset negative pressure so that the pressure relief valve does not open. However, during certain conditions, even when an amount of vacuum provided to the emission control system is adjusted to remain above the preset negative pressure, the pressure, e.g., the vapor pressure, in the fuel system may decrease below the preset negative pressure due to degradation of system components, e.g., a purge valve stuck open or the vacuum pump stuck on. In such a case, a fault may be indicated as described below.

During this test cycle, fuel system pressure is reduced, via actuation of purge valve 261 or via actuation of a vacuum pump to a predetermined pressure which is higher than the preset pressure. In some examples, the preset negative pressure and the predetermined pressure may be controlled by a vacuum pump coupled to said fuel vapor recovery system, e.g., ELCM 295. In other examples, the preset negative pressure and the predetermined pressure may be controlled by controlling a vapor purge valve, e.g., valve 261, coupled between an engine intake manifold and the fuel vapor recovery system.

At 310, method 300 includes monitoring pressure. For example, pressure changes in the fuel system may be monitored via a pressure sensor, e.g., pressure sensor 291, while vacuum is provided to the fuel system from the engine or from a vacuum pump to determine whether a leak or other fault is present in the emission control system by comparing the measured pressure changes to expected pressure changes in the system. Any suitable pressure measurements may be used to determine if a fault is present in the system, e.g., if pressure in the fuel system during the leak test remains above a threshold pressure for a duration then a leak may be indicated or a leak may be indicated based on a slope or rate of change of pressure measurements compared with expected or modeled pressure changes, etc. As remarked above, during certain conditions, even when an amount of vacuum provided to the emission control system is adjusted to remain above the preset negative pressure, the pressure, e.g., the vapor pressure, in the fuel system may decrease below the preset negative pressure due to degradation of system components. Thus, in some examples, a leak may be indicated in response to a pressure in the fuel system decreasing below the preset negative pressure while leak diagnostics are being performed.

Thus, at 312, method 300 includes determining if pressure is greater than a threshold pressure. This threshold pressure may be a predetermined expected pressure threshold to which pressure in the fuel system is expected to decrease in response to the vacuum generated in the fuel system during the diagnostic test. If pressure falls below the threshold at 312, then, in some examples, a no-leak condition may be indicated and method 300 may then proceed to 314 to determine if diagnostics are complete. If diagnostics are not complete at 314, method 300 may continue to monitoring the pressure at 310 to determine if faults are present in the system. However, if diagnostics are complete at 314 method 300 proceeds to 324 described below.

If pressure in the fuel system remains above the threshold at 312, e.g., for a predetermined duration, then method 300 proceeds to 316 to indicate a fault. In particular, leakage of fuel vapor may be indicated when said measurements of pressure changes in the fuel system exceed preselected values. Indication of a fault may include setting a diagnostic code in a diagnostic system in the vehicle and/or alerting a vehicle operator, e.g., via a suitable display, that a fault has been detected so that mitigating actions can be performed or maintenance scheduled.

After a fault is indicated at 316 or after diagnostics are complete at 314, method 300 proceeds to 324. At 324, method 300 includes determining if entry conditions for relief valve cleaning are met. Relief valve cleaning includes generating at least the preset negative threshold pressure in the fuel system at which the pressure relieve valve opens so that the relief valve least partially opens or unsticks so that the pressure relief valve remains operational to release pressure at the preset negative pressure to prevent too large a negative pressure forming in the fuel vapor recovery system or fuel tank.

In some examples, relief valve cleaning may be performed subsequent to, e.g., immediately following, a diagnostic test or a fuel vapor purging operation so that vacuum generated in the fuel system for the diagnostic test or for fuel vapor purging may be used to further decrease the pressure in the fuel system for the relief valve cleaning operation. However, in other examples, as described below, pressure relief valve cleaning may be periodically scheduled to be performed during engine operation.

Entry conditions for relief valve cleaning may be based on various vehicle operating conditions. In some examples, relief valve cleaning entry conditions may be based on an amount of vacuum in the fuel tank greater than a threshold amount (e.g., following a diagnostic test or a fuel vapor purging operation). As another example, relief valve cleaning may be based on an amount of time elapsed from a prior relief valve cleaning event. For example, relief valve cleaning may be scheduled to be performed at preselected time intervals so that operation of the valve is maintained.

If entry conditions for relief valve cleaning are met at 324, method 300 proceeds to 326. At 326, method 300 includes reducing fuel system pressure to a third pressure which is less than said preset pressure. For example, when not in the diagnostic test cycle and while a purge event is not occurring, pressure in the fuel system may be reduced to the third pressure which is less than said preset pressure in order to unstick the pressure relief valve. Reduction of pressure may be performed by providing vacuum to the fuel system via the engine intake during engine operation, e.g., by increasing an opening of purge valve 261, or by providing vacuum from a vacuum pump, e.g., ELCM 295, to decrease pressure in the fuel system to least partially open or unstick the negative pressure relief valve.

After the pressure is decreased to the third pressure which is less than the preset pressure, the relief valve may open leading to an increase in pressure in the fuel system at which point the relief valve cleaning event may be terminated, e.g., via discontinuing providing vacuum to the fuel system from the engine or pump.

Returning to 304, if diagnostic entry conditions are not met then method 300 proceeds to 318 to determine if purge conditions are met. Entry conditions for fuel vapor purging may be based on an amount of fuel vapor stored in a fuel vapor canister, e.g., canister 222, above a threshold. Purging conditions may additionally be based on temperature conditions and engine operating conditions. For example, determining if entry conditions for purging are met may include determining if the engine is in operation and a temperature in the emission control system greater than a threshold temperature. If purge conditions are not met at 318, method 300 proceeds to 324. However, if purge conditions are met at 318, method 300 proceeds to 320.

At 320, method 300 includes purging fuel vapors. For example, a vapor purge operation may be initiated to purge fuel vapors from the fuel vapor system into the engine intake manifold by operating the purge valve. For example, vent valve 229 may be opened and purge valve 261 may be opened so that vacuum from the engine intake is provided to the fuel vapor canister to draw fuel vapors stored in the fuel vapor canister into the engine intake for combustion. During purging operations, the fuel vapor system negative pressure may remain above the preset negative pressure which activates the pressure relief valve so that the pressure relief valve remains closed during the purging operation. However, during some conditions, even though vacuum provided to the fuel vapor canister, e.g., from the engine intake, is adjusted, e.g., via adjustment of purge valve 261, to remain above the preset negative pressure, the pressure in the fuel system may decrease below the preset negative pressure due to degradation of system components. Thus, in some examples, a leak may be indicated in response to a pressure in the fuel system decreasing below the preset negative pressure while fuel vapor purging is performed.

At 322, method 300 includes determining if purging is complete. For example, a purging operation may be performed for a predetermine time duration, e.g. based on an amount of fuel vapor stored in the fuel vapor canister at the initiation of the purge and based on engine operating conditions such as an amount of vacuum in the intake and a temperature in the emission control system. If purging is not complete at 322, method 300 continues purging at 320.

However, if purging is complete at 322 or if purge entry conditions were not met at 318, then method 300 proceeds to 324. At 324, method 300 includes determining if entry conditions for relief valve cleaning are met. As remarked above, in some examples, relief valve cleaning may be performed subsequent to, e.g., immediately following, a diagnostic test or a fuel vapor purging operation so that vacuum generated in the fuel system for the diagnostic test or for fuel vapor purging may be used to further decrease the pressure in the fuel system for the relief valve cleaning operation. However, in other examples, pressure relief valve cleaning may be scheduled to be performed periodically during engine operation. For example, pressure relief valve cleaning may be performed during any suitable engine operation conditions during which a leak test it not being performed and during which a purge operation is not being performed. For example, relief valve cleaning may be scheduled to be performed at preselected time intervals so that operation of the valve is maintained.

If entry conditions for relief valve cleaning are met at 324, method 300 proceeds to 326. At 326, method 300 includes reducing fuel system pressure to a third pressure which is less than said preset pressure in order to unstick the pressure relief valve. After the pressure is decreased to the third pressure which is less than the preset pressure, the relief valve may open leading to an increase in pressure in the fuel system at which point the relief valve cleaning event may be terminated, e.g., via discontinuing providing vacuum to the fuel system from the engine or pump.

FIG. 4 illustrates an example method, e.g., method 300 described above, for cleaning a pressure relief valve for a fuel tank, e.g., negative pressure relief valve 128 in capless fuel filler system 121, that is normally activated at a preset negative pressure in a fuel system. Graph 402 in FIG. 4 shows pressure, e.g., as measured by pressure sensor 291, versus time. Graph 404 shows a vacuum pump actuation, e.g., ELCM 295, versus time. Graph 406 shows a fuel vapor purge valve, e.g., valve 261, actuation versus time. Graph 408 shows a pressure relief valve, e.g., valve 128, versus time. In the example shown in FIG. 4, a vacuum pump is used to control pressures in the fuel system for leak diagnostics and relief valve cleaning However, in other examples, as described above, adjustment of the purge valve may instead be used to adjust pressure in the fuel system for relief valve cleaning and, in some examples, leak testing. For example, an amount of engine vacuum provided to the fuel system may be adjusted by adjusting an opening amount of the purge valve.

At time t1 in FIG. 4 a diagnostic test is initiated while the engine is not in operation. To generate vacuum for leak testing, a vacuum pump is operated, as shown in graph 404, to reduce pressure in the fuel system for leak testing. During the diagnostic test, pressure in the fuel system is monitored. Graph 402 shows example pressure curves for the fuel system with a first example pressure curve 412 for the case where there is no leak present in the system and a second example pressure curve 410 for the case where a leak is present. In particular, if a leak is present in the system, then as shown by curve 410 pressure in the fuel system may remain above a threshold pressure 416 for a predetermined duration, e.g., until time t3, when a leak is indicated in response to pressure above this threshold 416. In contrast, if a leak is not present, then pressure in the fuel system decrease below the threshold pressure 416 at time t2 at which point a no-leak condition may be indicated.

In some examples, leak diagnostics may be based on a comparison of a measured pressure in the fuel system with an expected pressure. For example, curve 412 may be used as an expected pressure for no-leak conditions and the measured pressure may be compared to curve 412 to determine if a leak is present, e.g., a leak may be indicated in response to the measured pressure greater than the expected pressure. Throughout the leak test, an amount of vacuum provided to the fuel system may be adjusted so that pressure in the fuel system remains above the preset negative pressure 414 at which a negative pressure relief valve opens or unsticks.

At time t3, after the leak test is complete, the test may be terminated. In some examples, since an increased amount of vacuum is present in the fuel system immediately following the diagnostic test, a relief valve cleaning operation may be initiated shortly after or immediately following the diagnostic test in order to take advantage of the increased vacuum conditions in the fuel system. Thus at time t3, operation of the vacuum pump may continue or a duty cycle of the pump may be increased to provide an increased amount of vacuum to the fuel system so that the pressure in the fuel system falls below the preset negative pressure 414 at time t4 which causes the pressure relief valve to open or become unstuck. Opening of the pressure relief valve at time t4 causes pressure in the fuel system to increase above the preset pressure 414 so that the relief valve again closes and the relief valve cleaning operation terminated.

Before time t5, engine operation may again be initiated, e.g., a key-on event may occur or a hybrid vehicle may switch from an engine-off mode to an engine-on mode. At time t5, a fuel vapor purging event is initiated so that a canister vent valve, e.g., valve 229, is opened and purge valve 406 is also opened so that vacuum from an intake of the engine is used to purge fuel vapors from the fuel vapor canister. Throughout the purge event an amount of vacuum provided to the fuel system may be adjusted so that pressure in the fuel system remains above the preset negative pressure 414. After a predetermined time duration, the purge event is terminated at time t6, e.g., by closing the vent valve and the purge valve.

Since an increased amount of vacuum is present in the fuel system immediately following the purge event, a relief valve cleaning operation may be initiated shortly after or immediately following the purge event in order to take advantage of the increased vacuum conditions in the fuel system. Thus at time t6, the vacuum pump may be actuated to provide an increased amount of vacuum to the fuel system so that the pressure in the fuel system falls below the preset negative pressure 414 at time t7 which causes the pressure relief valve to open or become unstuck. Opening of the pressure relief valve at time t7 causes pressure in the fuel system to increase above the preset pressure 414 so that the relief valve again closes and the relief valve cleaning operation terminated.

Relief valve cleaning may also be scheduled to perform periodically during engine operation, e.g., according to a predetermined schedule. Thus at time t8, another relief valve cleaning operation is initiated to that the vacuum pump is actuated to reduce pressure in the fuel system so that the pressure in the fuel system falls below the preset negative pressure 414 at time t9 which causes the pressure relief valve to open or become unstuck. Opening of the pressure relief valve at time t9 causes pressure in the fuel system to increase above the preset pressure 414 so that the relief valve again closes and the relief valve cleaning operation terminated.

By periodically performing relief valve cleaning and maintenance as described above, reduction in sticking of the pressure relief valve may be achieved so that the pressure relief valve remains operational to release pressure at the preset negative pressure to prevent too large a negative pressure forming in the fuel vapor recovery system or fuel tank.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for cleaning a pressure relief valve that is normally activated at a preset negative pressure in a fuel system, comprising:

via a controller: during a test cycle, reducing fuel system pressure with an actuator to a predetermined pressure which is higher than a preset pressure, and measuring pressure changes in said fuel system; and while vacuum generated in the fuel system for a diagnostic test is still present but after completion of the test cycle and when not in said test cycle, periodically reducing said fuel system pressure with the actuator to a third pressure which is less than said preset pressure, to force the pressure relief valve open even when stuck closed.

2. The method recited in claim 1 wherein said fuel system comprises a fuel tank, a capless fuel device including the pressure relief valve, and a fuel vapor recovery system coupled to the fuel tank including a vapor storage canister, wherein the actuator include valves coupled in the fuel system controlled by the controller.

3. The method recited in claim 1 wherein the preset negative pressure, said predetermined pressure, said preset pressure, and said third pressure are all fuel vapor pressures.

4. The method recited in claim 1 wherein leakage of fuel vapor is indicated when said measurements of pressure changes in the fuel system exceed preselected values.

5. The method recited in claim 1 wherein the fuel system is coupled to an internal combustion engine.

6. The method recited in claim 5 wherein said internal combustion engine and an electric motor propel a hybrid vehicle.

7. The method recited in claim 6 wherein said hybrid vehicle comprises a plug-in hybrid vehicle.

8. The method recited in claim 6 wherein reducing said fuel system pressure to the third pressure which is less than said preset pressure will unstick the pressure relief valve, wherein throughout the test cycle, an amount of vacuum provided to the fuel system is adjusted so that pressure in the fuel system remains above the preset negative pressure at which the pressure relief valve unsticks.

9. The method recited in claim 2 wherein the preset negative pressure, said predetermined pressure, said preset pressure, and said third pressure are controlled by a vacuum pump coupled to said fuel vapor recovery system.

10. The method recited in claim 2 wherein the preset negative pressure, said predetermined pressure, said preset pressure, and said third pressure are controlled by controlling a vapor purge valve coupled between an engine intake manifold and said fuel vapor recovery system.

11. A method for cleaning a pressure relief valve that is normally activated at a preset negative pressure in a fuel system, comprising:

via a controller, during a diagnostic test, reducing fuel system pressure with an actuator to a predetermined pressure which is higher than a preset pressure, measuring pressure changes in said fuel system from a sensor, and indicating a fault when said measurements exceed a threshold; and when not performing said diagnostic test, periodically reducing said fuel system pressure with the actuator to a third pressure which is less than said preset pressure immediately after said diagnostic test to force the pressure relief valve open even when stuck closed.

12. The method recited in claim 11 wherein the fuel system is coupled to an internal combustion engine.

13. The method recited in claim 12 wherein said internal combustion engine and an electric motor propel a hybrid vehicle.

14. The method recited in claim 13 wherein said periodically reducing said fuel system pressure to said third pressure occurs during operation of said internal combustion engine.

15. The method recited in claim 11 wherein the diagnostic test generates vacuum in the fuel system for the diagnostic test that is then used to further decrease pressure in the fuel system for a periodic valve cleaning operation.

16. The method recited in claim 12 wherein said fuel system comprises a fuel tank, a capless fuel device including the pressure relief valve, and a fuel vapor recovery system coupled to the fuel tank including a vapor storage canister.

17. The method recited in claim 16 further comprising purging said fuel vapor recovery system into an intake manifold of said internal combustion engine.

18. The method recited in claim 17 wherein said periodically reducing said fuel system pressure to said third pressure occurs immediately after said purging of said fuel vapors.

19. A method for performing operations on a fuel vapor system having a vapor absorbing canister coupled between a fuel tank and an engine intake via a purge valve, and a pressure relief valve which opens at a preset negative pressure to limit maximum negative pressure in the fuel vapor system, comprising:

a vapor purge operation purging fuel vapors from the fuel vapor system into the engine intake manifold by operating the purge valve;

a test operation reducing fuel system pressure to a predetermined pressure which is higher than a preset pressure, measuring pressure changes in said fuel vapor system, and indicating a fault when said measurements exceed a threshold; and a pressure relief valve cleaning operation performed immediately after at least one of the vapor purge operation and the test operation and responsive to completion of at least one of the test operation and completion of the vapor purge operation, the cleaning operation further reducing said fuel system pressure to a third pressure which is less than said preset pressure to force the pressure relief valve open even when stuck closed.

20. The method recited in claim 19 wherein said operations are not performed concurrently.

* * * * *